United States Patent [19]

Hishinuma et al.

[11] Patent Number: 4,823,585

[45] Date of Patent: Apr. 25, 1989

[54] HOT ROLLING METHOD

[75] Inventors: Itaru Hishinuma; Akio Adachi; Ko Toyoshima, all of Chiba, Japan

[73] Assignee: Kawasaki Steel Corporation, Kobe, Japan

[21] Appl. No.: 941,578

[22] Filed: Dec. 15, 1986

Related U.S. Application Data

[63] Continuation of Ser. No. 706,101, Feb. 27, 1985, abandoned.

[30] Foreign Application Priority Data

| | | | |
|---|---|---|---|
| Feb. 29, 1984 | [JP] | Japan | 59-37478/84 |
| May 29, 1984 | [JP] | Japan | 59-107553/84 |
| Oct. 1, 1984 | [JP] | Japan | 59-204147/84 |

[51] Int. Cl.[4] ..... B21B 31/18; B21B 31/20

[52] U.S. Cl. ..... 72/247; 72/199; 72/243

[58] Field of Search ..... 72/247, 245, 243, 241, 72/237, 199, 240, 20, 21, 365, 366

[56] References Cited

U.S. PATENT DOCUMENTS

| | | | |
|---|---|---|---|
| 3,857,268 | 12/1974 | Kajiwaka | 72/247 |
| 3,902,345 | 9/1975 | Shida | 72/247 X |
| 3,943,742 | 3/1976 | Kajiwara et al. | 72/247 |
| 4,581,914 | 4/1986 | Masui | 72/243 X |

FOREIGN PATENT DOCUMENTS

| | | | |
|---|---|---|---|
| 2260256 | 6/1973 | Fed. Rep. of Germany . | |
| 2950473 | 6/1980 | Fed. Rep. of Germany . | |
| 0033111 | 4/1981 | Japan | 72/240 |
| 0181708 | 11/1982 | Japan | 72/247 |
| 0176002 | 10/1983 | Japan | 72/247 |
| 0209402 | 12/1983 | Japan | 72/243 |
| 0064103 | 4/1984 | Japan | 72/247 |
| 0110401 | 6/1984 | Japan | 72/247 |
| 0400389 | 10/1973 | U.S.S.R. | 72/241 |

*Primary Examiner*—Robert L. Spruil
*Assistant Examiner*—Steven B. Katz
*Attorney, Agent, or Firm*—Balogh, Osann, Kramer, Dvorak, Genova & Traub

[57] ABSTRACT

A hot rolling method using a hot finishing mill including a pair of work rolls each having a taper ground end at one end of its barrel and arranged one above the other with the taper ground ends being on opposite sides so as to locate both edges of a plate-like material to be rolled in respective zones of the taper ground ends. Work rolls are cyclically shifted in their axial direction within a range so as not to permit the both edges of the material to come out of the taper ground ends of the work rolls, thereby preventing edge built-ups of the material and simultaneously effecting crown-controlling of the rolled material. The work rolls are finely shifted and simultaneously a bending action is applied to the work rolls in a manner to eliminate a bending action acting upon the work rolls caused by the material being rolled by the work rolls. The work rolls are cyclically shifted, while a distance from an edge of the material to a starting point of the taper ground end of the work roll nearest to the edge of the material is variably set so as to decrease dependently upon increase of thermal expansion of the work rolls. Stepwise variation in shifting distance of the work rolls per unit number of rolled material is varied in a rolling cycle.

4 Claims, 16 Drawing Sheets

(Before Thermal Expansion)

(After Thermal Expansion)

Material: JIS SPPC Thicknees: 2.3mm
Width: 935mm
(Finishing Mill Having Six Roll Stands Among which Three Stands F3, F4 and F5 are Shifted)

HOT ROLLING METHOD

This application is a continuation of application Ser. No. 706,101, filed Feb. 27, 1985, now abandoned.

BACKGROUND OF THE INVENTION

1. Field of the Invention

This invention relates to a hot rolling method for avoiding edge build-up and edge drop of rolled strips or plates by preventing local wear of work rolls of rolling mills such as four or six high mills simultaneously controlling shapes of steel strips or plates by crown-controlling.

2. Description of the Prior Art

Recently, there has been an increasing need to improve the accuracy in thickness of steel strips or plates rolled by rolling mills in order to improve the yield rate of the steel. To meet this need, various crown-controlling methods have been proposed. Among them, a taper end roll rolling method is effective to prevent edge drops with the aid of particular geometrical shapes of work rolls, (for example, as disclosed in Japanese patent application Publication No. 20,081/81).

In this case, the effect of crown-controlling tends to decrease with change in width of steel strips or plates. To avoid this, a work roll shift method is effective for the crown-controlling, (as disclosed in Japanese patent application Publication No. 151,552/78).

In hot finish rolling, as the number of rolled strips having the same width increases, work rolls 1 progressively wear to form tracks or traces 2 for strips or plates, whose edge portions **2*b* usually wear deeper than in center portions 2*a* as shown in FIG. 1. As a result, the rolled strip 3 has a sectional profile including at its edges irregular protrusions or ridges p and p' which are referred to as "edge build up" as shown in FIG. 2**. It is clearly evident that such an edge built-up causes the greatest difficulty for crown-controlling of strips and roll-change-free rolling which is a rolling with a pair of work rolls over a wide range of sizes of strips or plates to be rolled without changing the rolls. The same holds true in the above crown-controlling by the use of the taper end rolls.

SUMMARY OF THE INVENTION

It is an object of the invention to provide an improved hot rolling method capable of preventing edge built-up caused by uneven wear in work rolls at tracks for strips or plates and making it possible to effect the crown-controlling so as to do roll-chance-free rolling.

In order to achieve this object, the present invention provides a hot rolling method using a hot finishing mill including a pair of work rolls, each having a taper ground end at one end of its barrel and arranged one above the other with the taper ground ends being on opposite sides so as to locate both edges of a plate-like material to be rolled in respective zones of the taper ground ends. According to the invention the work rolls are shifted in their axial directions within a range so as not to permit the both edges of the material to come out of the taper ground ends of the work rolls, thereby preventing edge built-ups of the material and simultaneously effecting crown-controlling of the rolled material.

In a preferred embodiment of the invention, the work rolls are cyclically shifted.

In carrying out the invention, the range for shifting the work rolls is between the maximum where shapes of the material on an exit side of the work rolls do not exceed a limit value and the minimum where crown-controlling performance of the work rolls for the material is still maintained.

It is another object of the invention to provide a hot rolling method capable of effectively suppressing edge built-ups without detrimentally affecting the crown of strips which would be caused by fine shifting of work rolls, thereby establishing the roll-chance-free rolling with taper end work rolls being shifted.

To achieve this object, according to the invention the work rolls are finely shifted and simultaneously a bending action is applied to the work rolls in a manner to eliminate a bending action acting upon the work rolls caused by the material being rolled by the work rolls.

It is a further object of the invention to provide a hot rolling method with work rolls being shifted in a roll shift pattern determined in consideration of thermal expansion of the rolls in addition to equalization or mitigation of wear of roll to reduce the crown of rolled strips and to stabilize the profiles of rolled strips.

In order to accomplish this object, according to the invention the work rolls are cyclically shifted, while a distance from an edge of the material to a starting point of the taper ground end of the work roll (nearest to the edge of the material), is variably set so as to decrease depending upon the increase of thermal expansion of the work rolls.

It is still a more specific object of the invention to provide a hot rolling method capable of effectively reducing the crown of rolled strips throughout a rolling cycle by simply setting suitable initial crowns on work rolls without causing irregularities in crown of rolled strips which would unavoidably be caused by variations in kinds of steel, periods of rolling allowed by individual pairs of work rolls, and thermal crowns of work rolls due to heat.

For this end, according to the invention stepwise variation in shifting distance of the work rolls per unit number of rolled material is varied in a rolling cycle.

Preferably, the stepwise variation is made smaller in a first half of the rolling cycle and is made larger in a latter half of the cycle.

The invention will be more fully understood by referring to the following detailed specification and claims taken in connection with the appended drawings.

Figure 4:
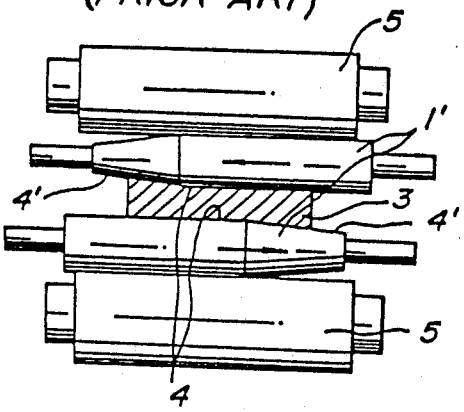
FIG 4 (PRIOR ART)
Figure 5:
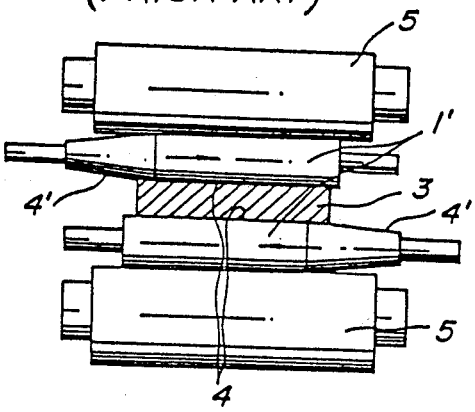
FIG 5 (PRIOR ART)
Figure 6:
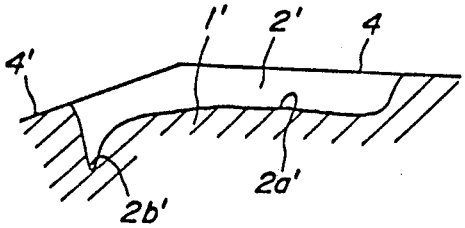
FIG 6 (PRIOR ART)
Figure 7:
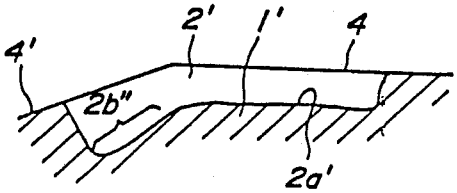
FIG 7 (PRIOR ART)
Figure 10A:
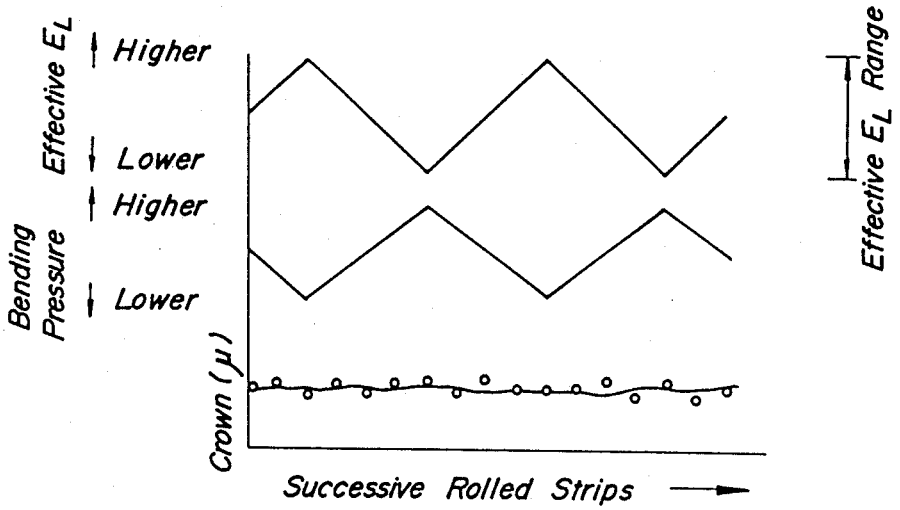
Figure 10B:
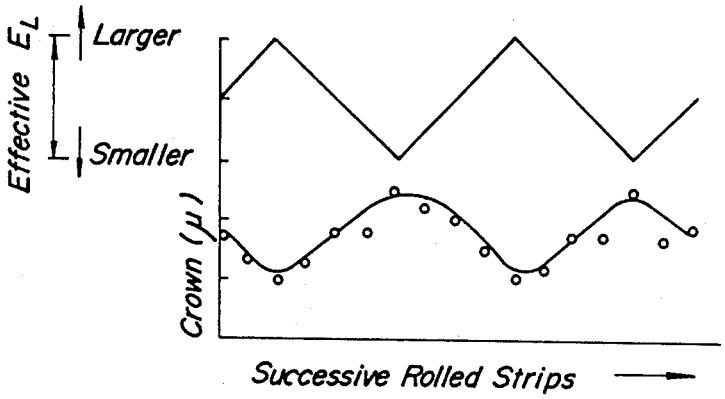
Figure 11A:
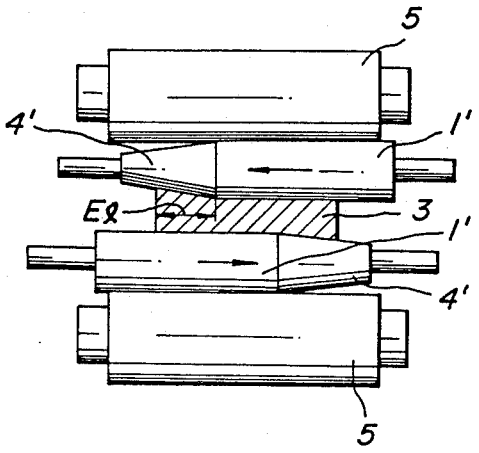
Figure 11B:
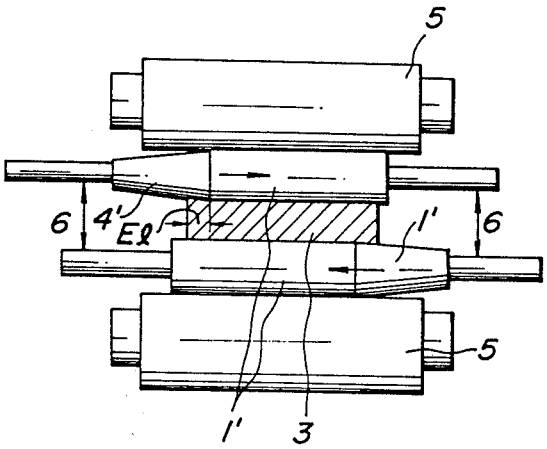
Figure 12:
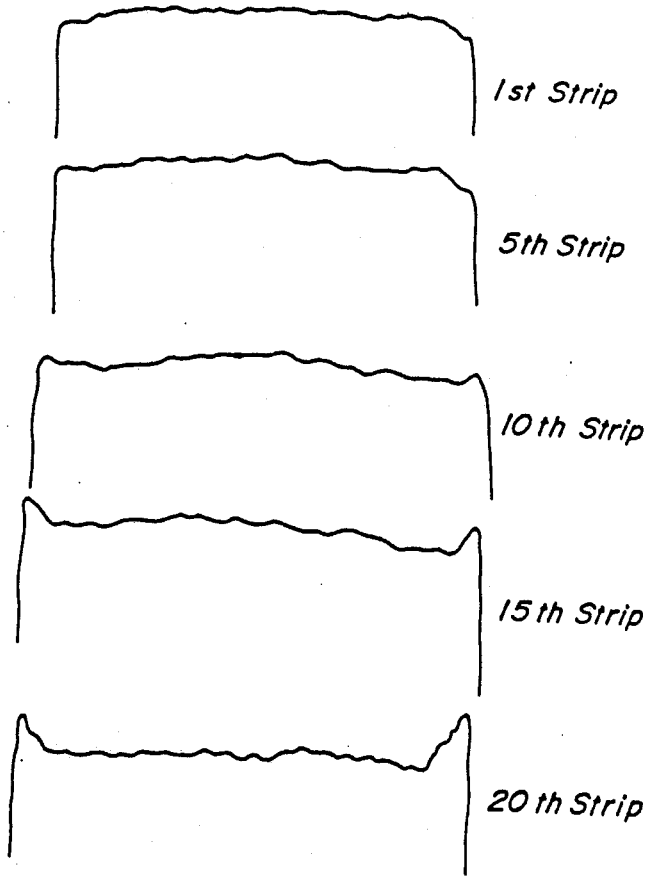
FIG 12 (PRIOR ART)
Figure 13:
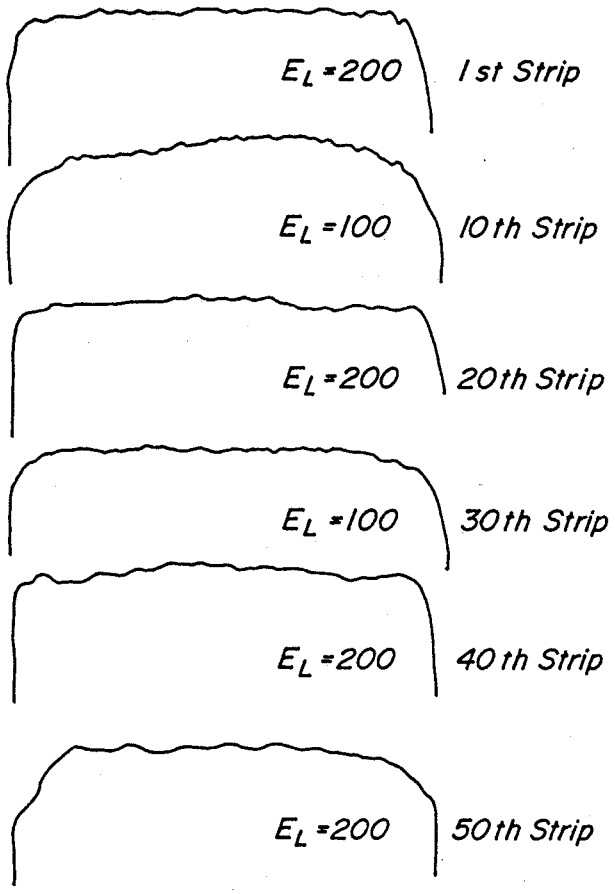
Figure 14:
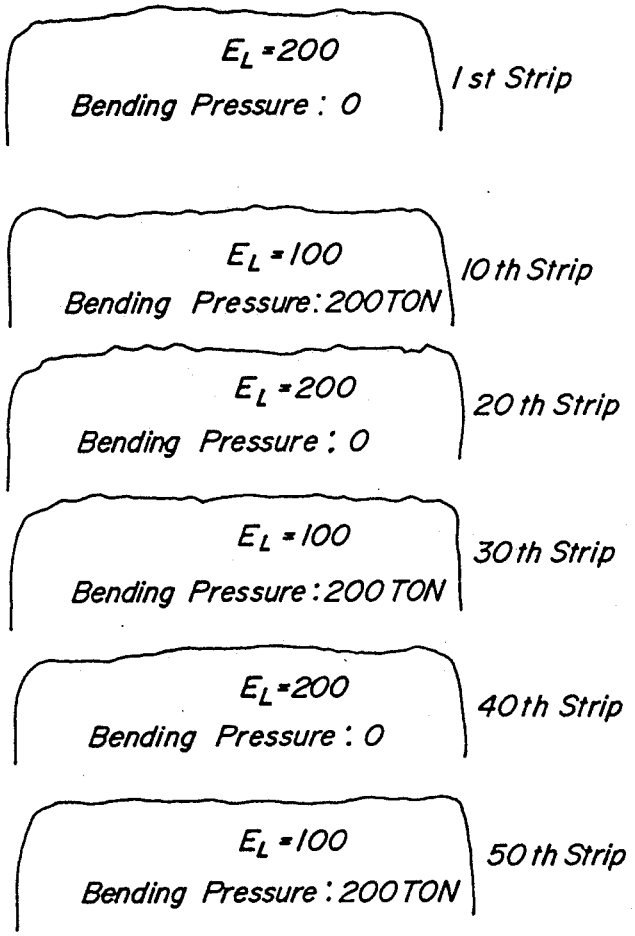
Figure 15A:
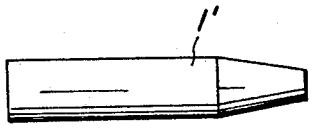
Figure 15B:
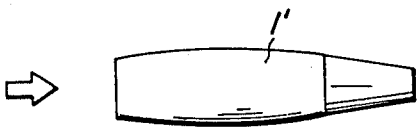
Figure 16:
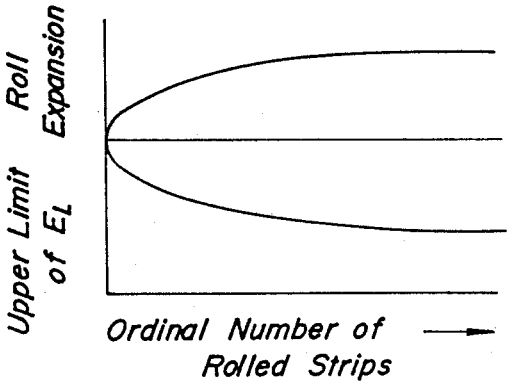
Figure 17:
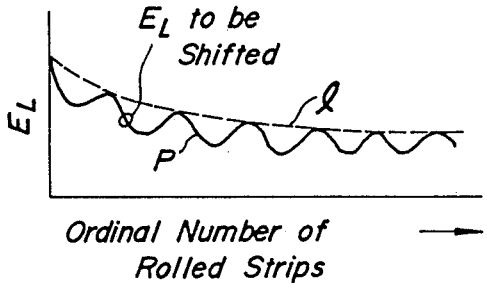
Figure 18A:
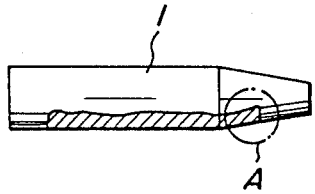
Figure 18B:
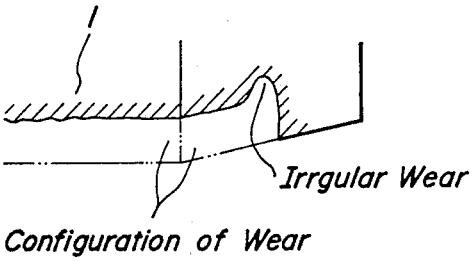
Figure 19:
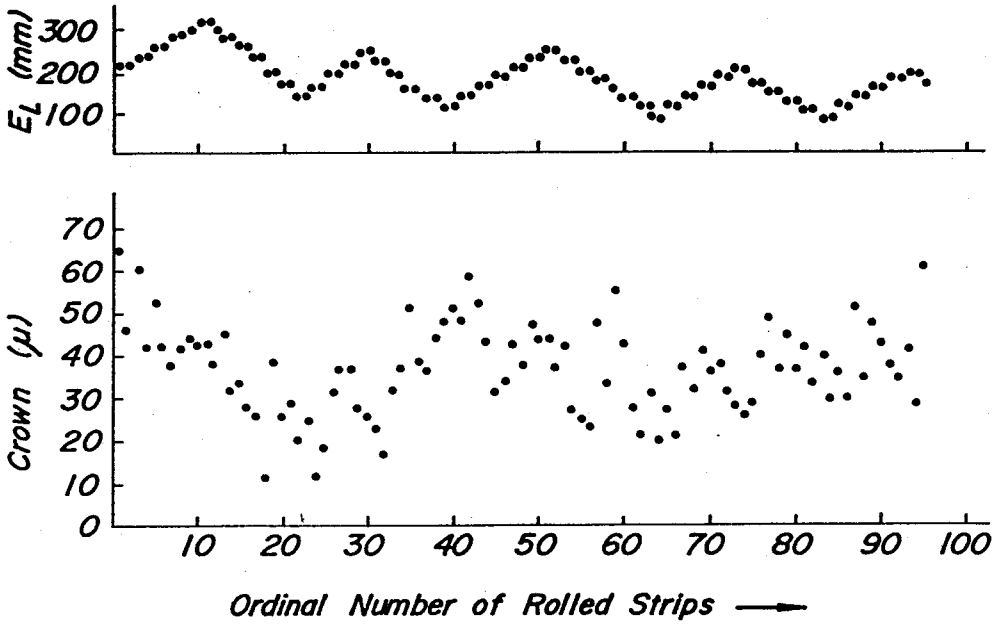
Figure 20A:
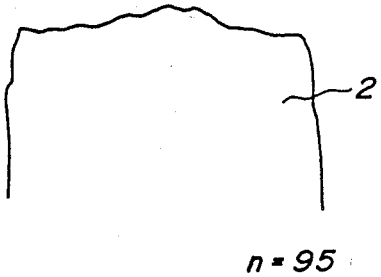
Figure 20B:
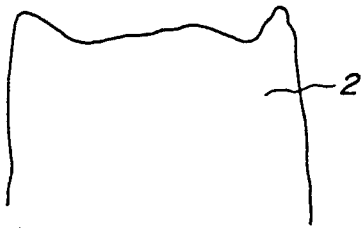
Figure 21:
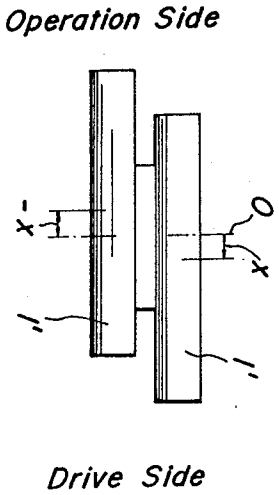
Figure 22:
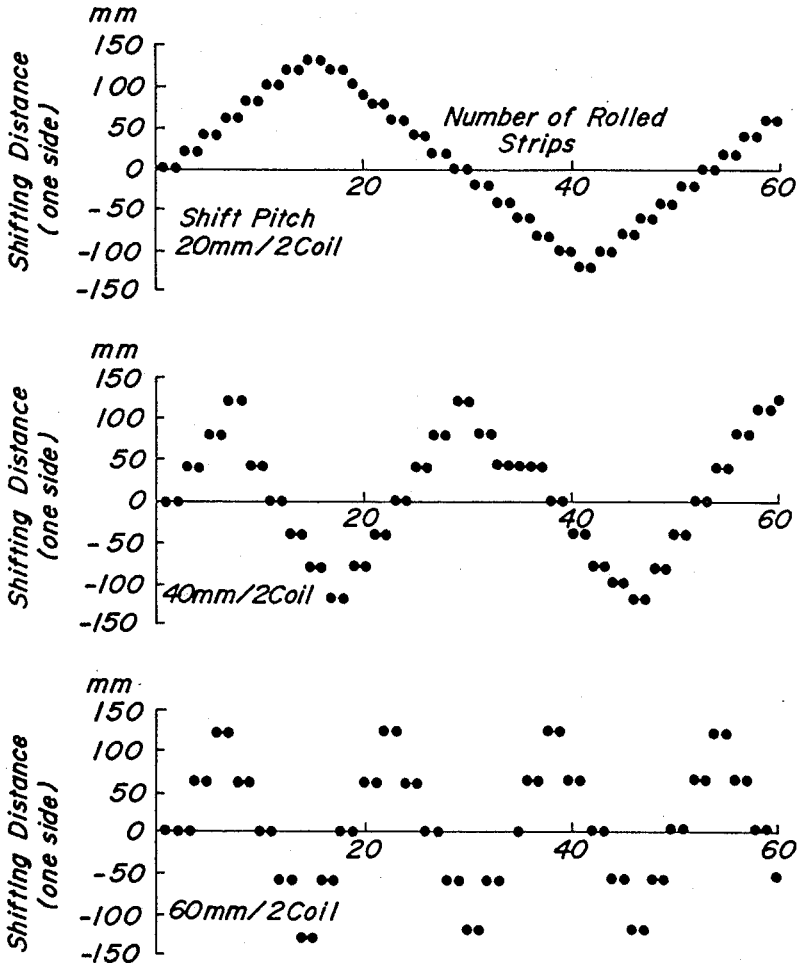
Figure 23:
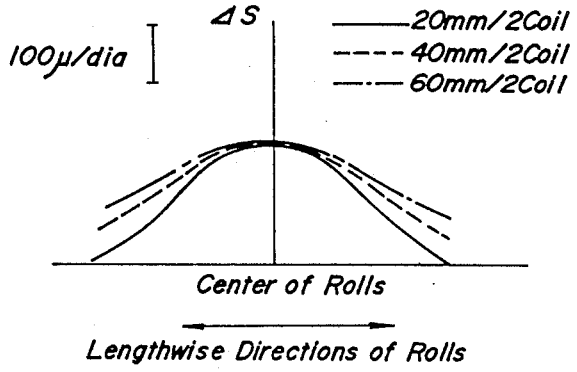
Figure 24:
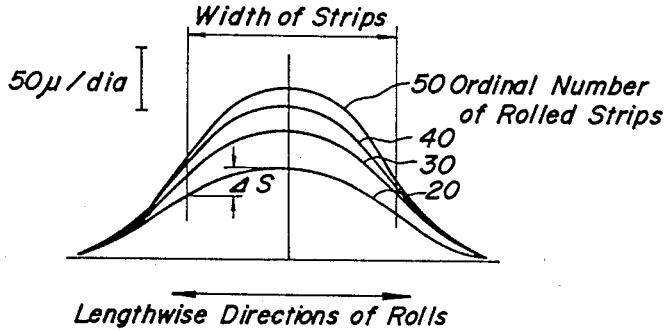
Figure 25:
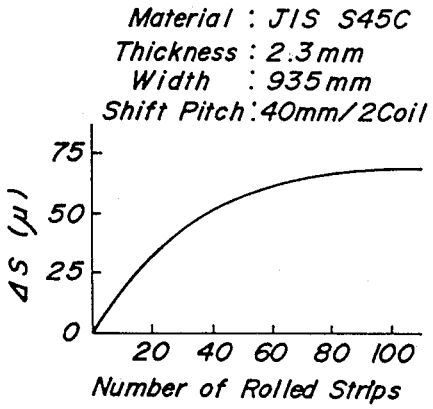
Figure 26:
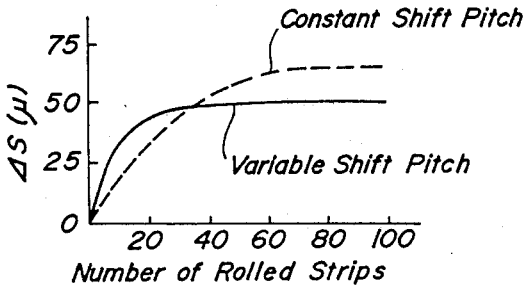
Figure 27:
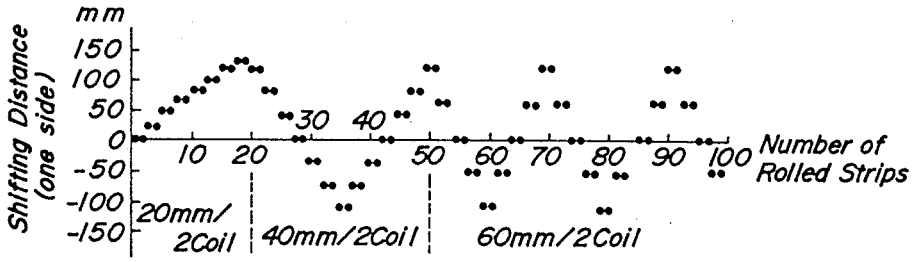
Figure 28:
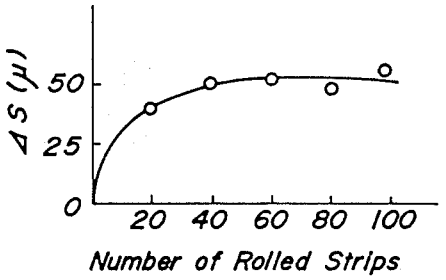

FIG. **3*a*** is a sectional view illustrating rolling of a strip by taper end work rolls;

FIG. **3*b*** is a graph showing an effective $E_L$ zone;

FIG. 4 is an explanatory elevation illustrating a rolling condition with the maximum $E_L$;

FIG. 5 is a explanatory elevation showing a rolling condition with the minimum $E_L$;

FIG. 6 is a partial sectional view of a work roll illustrating a deep wear;

FIG. 7 is a partial sectional view of a work roll illustrating an equalized or mitigated wear therein;

FIGS. **8*a*–8*c*** illustrate profiles of strips rolled in the prior art method;

FIGS. 9a–9d illustrate profiles of strips rolled according to the invention;

FIG. 10a is a graph illustrating uniform crowns of strips rolled according to the invention;

FIG. 10b is a graph illustrating the variation in crown of strips rolled without bending action upon work rolls;

FIGS. 11a and 11b are schematic views for explaining one embodiment of the invention;

FIG. 12 illustrates profiles of strips rolled with a constant $E_L$ value of 200 mm;

FIG. 13 illustrates profiles of strips rolled with variable $E_L$ value with work rolls subjected to fine cyclic shifting;

FIG. 14 illustrating profiles of strips rolled according to the invention;

FIGS. 15a and 15b are elevations of a work roll for explaining the thermal expansion;

FIG. 16 is a graph for explaining how to determine the $E_L$ value in consideration of the thermal expansion of work rolls;

FIG. 17 is a graph for explaining the shift of the $E_L$ value in consideration of mitigation of wear of the rolls;

FIGS. 18a and 18b are schematic views illustrating irregular wear in a roll;

FIG. 19 is graphs illustrating reduced crown of rolled strips resulting from $E_L$ values;

FIG. 20a is a profile of a strip rolled in consideration of thermal expansion according to the invention;

FIG. 20b is a profile of a rolled strip including defective edges caused by irregular wear of work rolls;

FIG. 21 is a schematic view for explaining the shifting distance of rolls;

FIG. 22 illustrates various shift pitch patterns of work rolls in carrying out the invention;

FIG. 23 is a graph illustrating a comparison of difference ΔS in roll diameters with respect to respective shift pitches;

FIG. 24 is a graph illustrating the difference ΔS dependent upon number of rolled strips;

FIG. 25 is a graph illustrating the relation between the difference ΔS and the numbers of rolled strips;

FIG. 26 is a graph illustrating the effect of variation in shift pitch on the difference ΔS;

FIG. 27 is a graph illustrating shift pitch patterns used in actual rolling according to the invention; and FIG. 28 is a graph illustrating the suppression of the difference ΔS resulting from the shift pitch patterns shown in FIG. 27.

DETAILED DESCRIPTION OF THE PREFERRED EMBODIMENT

Figure 1:
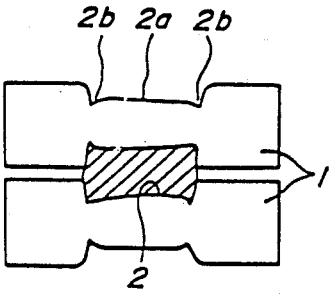
FIG 1 (PRIOR ART)
FIG. 1 is a schematic view of work rolls illustrating their wear.
Figure 2:
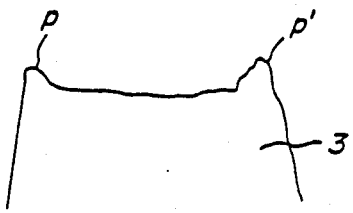
FIG 2 (PRIOR ART)
FIG. 2 is an exemplary view of a profile of a rolled strips including edge built-ups.
Figure 3A:
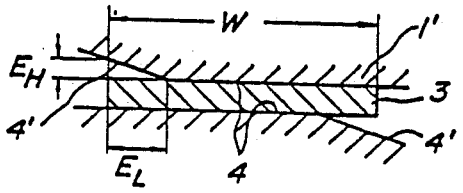
FIG 3a (PRIOR ART)

In crown-controlling using a pair of work rolls 1' which are so called "taper end rolls" each having a taper ground end 4' at one end of a roll barrel 4 and are arranged one above the other with the taper ground ends on opposite sides so as to locate both edges of strips or plates 3 to be rolled in respective zones of the taper ends 4' as shown FIG. 3a, the inventors have found effective $E_L$ values to be determined by limit values in shape of strips determined by roll stands, where $E_L$ is a distance from an edge of the strip to a starting point of the taper ground end, while a relief $E_H$ of the strip 3 at its edge relative to the taper ground end 4' is constant.

If the work rolls are shifted to an excessive extent beyond the effective $E_L$ value, the shape of a rolled strip on an exit side of the rolls exceeds its limit value making it impossible to carry out the rolling. On the other hand, if the work rolls are shifted to a too small extent beyond the opposite limit of the effective $E_L$ value, the crown-controlling performance of the work rolls is not capable of controlling crown of rolled strips.

The inventors further investigated the effective $E_L$ value to achieve this hot rolling method capable of preventing the edge built-up of rolled strips or plates so as to enable the crown-controlling and roll-change-free rolling to be effected.

Figure 3B:
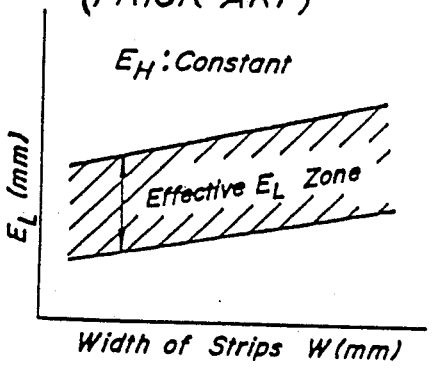
FIG 3b (PRIOR ART)

One embodiment of the invention applied to a four high mill will be explained hereinafter. FIG. 4 illustrates a shiftedmost position of work rolls when the $E_L$ value shown in FIG. 3 is increased to its maximum but not exceeding a limit value of a shape of strips on an exit side of the rolls. FIG. 5 shows a shiftedleast position of work rolls when the $E_L$ value is decreased to its minimum but still maintaining their crown-controlling performance. A reference numeral 5 denotes back up rolls.

In the event that the work rolls 1' are cyclically shifted so as to permit the $E_L$ to be within the range of the effective $E_L$ values from FIG. 4 to FIG. 5, a local wear 2b'' in a track or trace 2' for strips can be equalized or mitigated in an axial direction of the work roll even after the number of rolled strips has increased as shown in FIG. 7, instead of a deep local wear 2b' in case of a constant $E_L$ value as shown in FIG. 6.

Figure 8A:
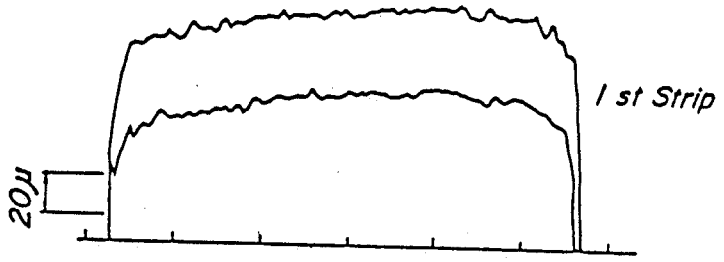
FIG 8a (PRIOR ART)
Figure 8B:
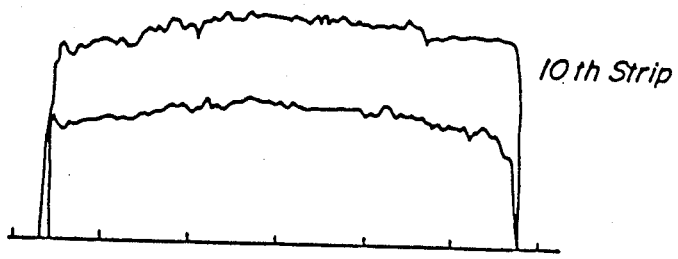
FIG 8b (PRIOR ART)
Figure 8C:
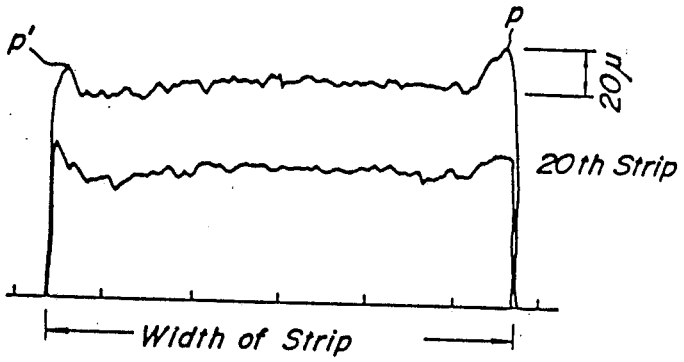
FIG 8c (PRIOR ART)
Figure 9A:
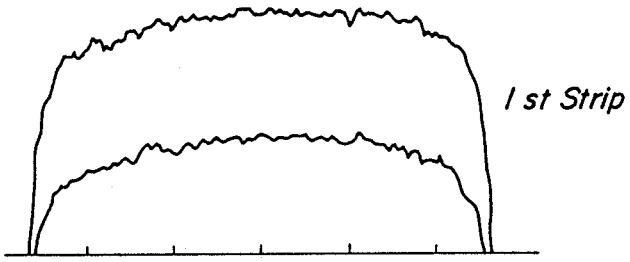
Figure 9B:
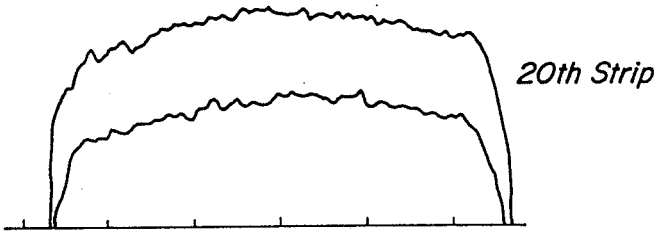
Figure 9C:
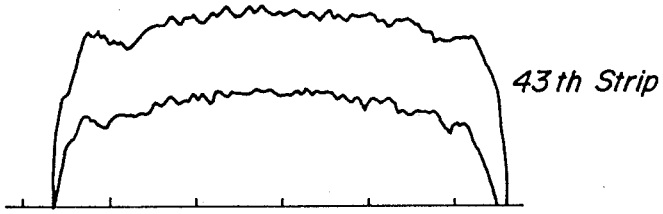
Figure 9D:
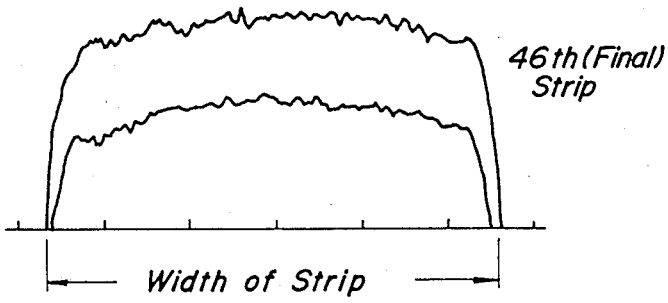

In order to more clarify this fact, FIGS. 8a, 8b and 8c illustrate one example of variation in sectional profile of strips on exit sides having thicknesses of 2.0 mm and widths of 1,040 mm according to Japanese Industrial Standards (JIS) SPHC continuously rolled by the taper end roll rolling method with a constant $E_L$ of 200 mm. As can be seen from these drawings, the profiles were not largely varied when a tenth strip had been rolled. However, when a twentyth strip has been rolled, remarkable edge built-ups p and p' occurred to the maximum heights of as much as 20μ which made it impossible to continue the rolling of strips having the same width.

FIGS. 9a–9d illustrate the variation in sectional profile of strips similar to those of FIGS. 8a–8c continuously rolled with work rolls being cyclically shifted by 20 mm per two strips with the $E_L$ values of 200–100 mm according to the invention. Even after forty-six strips having the same width had been rolled, any perceptible edge built-ups were not recognized.

As can be seen from the above description, the hot rolling method according to the invention can equalize or mitigate local wears in tracks or traces in work rolls for strips having the same width, to effectively maintain the sufficient crown-controlling or effect for preventing edge drops, thereby simultaneously making compatible the roll-chance-free rolling and crown-controlling for the strips.

In carrying out the method according to the invention, when work rolls are finely shifted within the range corresponding to the effective $E_L$ value, the crown of the rolled strips becomes larger as shown in FIG. 10b. In other words, the crowns of the strips rolled by the work rolls finely shifting within the effective $E_L$ value vary within a fairly wide range.

Another embodiment of the invention solves this problem. FIG. 11a illustrates work rolls 1' positioned at the maximum $E_L$ value but not exceeding a limit value of a shape of strips on an exit side of the work rolls. When the work rolls 1' are being shifted to make the $E_L$ value smaller, according to this embodiment of the invention an increasing bending action is applied to the work rolls as shown by a reference numeral 6 in FIG. 11*b* compatible with the reduced value of the $E_L$. FIG. 11*b* illustrates the work rolls 1' positioned at the minimum $E_L$ value but still maintaining their crown-controlling performance, in which position the work rolls are subjected to the maximum bending action.

In this case, the bending action is applied to the work rolls in such a manner to eliminate or cancel a bending action acting upon the work rolls caused by the strip being rolled by the work rolls. One preferred method of applying such a bending action to the work rolls is to apply loads to both journals of the work rolls in transverse directions substantially perpendicular to axes of the work rolls.

As shown in FIG. 10*a*, according to this preferred embodiment, the crowns are substantially constant for successive rolled strips. In this manner, this embodiment is very advantageous to effect the crown-controlling of strips for making crowns of the strips substantially constant and simultaneously the roll-chance-free rolling or rolling strips of wide range of widths without changing work rolls.

FIG. 12 illustrates sectional profiles of successive strips (JIS) SPHC having thicknesses of 2.0 mm and widths of 1,040 mm with the constant $E_L$ value of 200 mm according to the prior art. A twentieth strip included remarkable edge built-ups 5' having a height of 20μ. It was clearly impossible to continue further rolling with the same width strips.

FIG. 13 illustrates sectional profiles of strips (JIS) SPHC having thicknesses of 2.0 mm and widths of 1,040 mm rolled with the $E_L$ value of 100–200 mm. Work rolls were finely cyclically shifted so as to reduce the $E_L$ value by 20 mm per two rolled strips without applying any bending action on the work rolls. After fifth strips having the same widths had been rolled, any edge built-up did not occur. However, crowns varied greatly to be larger than those in FIG. 12.

FIG. 14 illustrates sectional profiles of strips (JIS) SPHC having thicknesses of 2.0 mm and widths of 1,040 mm rolled with the $E_L$ value of 100–200 mm. Work rolls were finely shifted so as to reduce the $E_L$ value by 20 mm per two rolled strips and were subjected to the increasing bending action of 0 to 200 tone/one chock as the $E_L$ value decreased.

In this case, after fifty strips had been rolled, any edge built-up did not occur and crowns of the rolled strips were substantially constant to obtain rolled strips having good sectional profiles throughout the rolling cycle.

This preferred embodiment of the invention can effectively suppress the edge built-up on rolled strips or plates without detrimentally affecting crowns of the strips so as to eliminate the disadvantage in the roll-chance-free rolling, whereby the hot rolling method with high accuracy as to thickness is accomplished.

A further embodiment will be explained hereinafter, which takes into consideration the thermal expansion of rolls.

When the hot rolling is continued according to the invention as shown in FIGS. 11*a* and 11*b*, the work rolls 1' will thermally expand from a configuration shown in FIG. 15*a* to that shown in FIG. 15*b*. If the rolling is continued with a constant $E_L$ value which is set in an initial rolling stage with less thermal expansion, center zones of rolled strips are rolled to excessive extent in comparison with edge zones of the strips to form waves therein, which make difficult to pass through the work rolls. This is caused by increase of the effect decreasing the crown of the rolled strips.

In order to avoid this, according to this embodiment, the upper limit of the $E_L$ value is determined at a value corresponding to the limit value causing to the above mentioned waves in the center zones of the rolled strips and the $E_L$ value is successively reduced dependingly upon the thermal expansion of the work rolls to determine an effective variable $E_L$ value as shown in a line l in FIG. 16.

Thermal expansions of the work rolls corresponding to numbers of rolled strips are preferably measured with actual rolling conditions to previously determine the data of the thermal expansions, on the basis of which the $E_L$ values of the rolls are previously determined. The thermal expansions may be experimentally determined with the aid of theoretical equations in thermodynamics.

In this case, moreover, the variable $E_L$ value shown in a broken line l is slightly shifted, as shown in a curve P in FIG. 17 so as to equalize or mitigate the wear of work rolls to achieve the decrease of crown and the stability of rolled strips.

The upper limit value of the $E_L$ value is determined with the aid of the pattern or curve P shown in FIG. 17. In this manner, the profiles of rolled strips are not detrimentally affected by the thermal expansion of the rolls, and the irregular wears in the rolls are equalized or mitigated as a rolling cycle proceeds. The irregular wears would otherwise occur in tracks of the rolls for strips as shown in FIGS. 18*a* and 18*b*. This effect is particularly remarkable in the case of rolling in order of wider strips to narrower strips.

FIGS. 19 and 20*a* and 20*b* illustrate results of the rolling according to the invention wherein strips of (JIS) SPHC having thicknesses of 2.0–2.6 mm and widths of 750–950 mm are rolled with $E_L$ values 100–300 mm decreasing depending upon thermal expansion of rolls by means of six roll stands of a finishing mill, among which three stands F2, F4 and F5 include taper ends rolls. In these examples, the work rolls were finely shifted by 20 mm near two rolled strips.

FIG. 19 shows the $E_L$ values set in the cycle and crowns μ of the rolled strips. The plotted crowns are thicknesses at centers of the rolled strips minus thicknesses at locations 25 mm inwardly spaced from edges of the strips. As can be seen from FIG. 19 the crowns of the rolled strips were reduced to 35μ on an average. Furthermore, by finely shifting the work rolls, profiles of the rolled strips became stable as shown in FIG. 20*a* to prevent defective profiles due to irregular wear of rolls as shown in FIG. 20*b*.

As can be seen from the above embodiment, it is important to take into consideration the so called "thermal crown" of rolls or the crown of rolls due to their thermal expansion which would detrimentally affects the crown of rolled strips. It has been known that the variation in crown of rolls depends not only upon periods of rolling allowed by individual pairs of work rolls, actual rolling time, water-cooling conditions and others, but also kinds of steel to be rolled, sizes of strips to be rolled and the like. Moreover, it is known that the behavior of increasing the crown is different from each other in former and latter halves of the rolling cycle.

As a result of various investigations and experiments on the rolling with shifting work rolls by the inventors, it has been found that the distribution of the thermal crown along the roll barrel varies with shift pattern of work rolls, or the profile of the thermal crowns depends upon the shift pattern of the work rolls.

By utilizing this discovery, the inventors intended to reduce the crown of rolled strips with the aid of variation in shift pitch in rolling cycles.

If shift patterns of work rolls are invariably determined without considering kinds of steel, periods of rolling allowed by individual pairs of work rolls, and first and latter halves of a rolling cycle, irregularities in the crown of rolled strips unavoidably occur throughout the rolling cycle due to difference in increasing of thermal crown of rolls in their lengthwise directions. In this case, when the difference ΔS in roll diameter at centers and edges of strips to be rolled in the first half of rolling is relatively small, the crown of strips becomes large. On the other hand, in the latter half of rolling, the difference ΔS becomes larger to reduce the crown of the strips, but there is a tendency for the rolled strips to form waves in their centers resulting in defective strips.

This results from the fact that although the larger crown of work rolls is effective to reduce the crown of rolled strips, initial crown of the work rolls is obliged to be small in order to avoid defective rolled strips having waves at centers in the latter half of rolling, with the result that the crown of the rolled strips is too large in the initial half of rolling and therefore irregularities in crown of rolled strips becomes larger throughout the rolling cycle.

FIG. 21 illustrates the shifting of work rolls 1' relative to a center O of a track of strips or plates. The "shifting distance" of rolls is defined by a distance x from the center O of the track of strips to centers of barrels of the work rolls on both drive and operation sides.

The shifting distance x of rolls is stepwise increased per a predetermined number of rolled strips until the shifting distance x becomes the maximum, for example, 100 mm and thereafter is stepwise decreased per the predetermined number of the strips. A "shift pitch" is defined by stepwise increase or decrease of shifting distance of rolls per unit number of rolled strips or plates in the repetition of the above shifting operations or cyclic roll shifting.

In rolling for obtaining (JIS) SPCC strips having thicknesses of 2.3 mm and widths of 935 mm, the roll shifting operation is simultaneously applied to three roll stands F3, F4 and F5 of a finishing mill having six roll stands with constant shift pitches 20 mm/2 coil, 40 mm/2 coil and 60 mm/2 coil in cyclic system as shown in FIG. 22. FIG. 23 illustrates results of the rolling.

It is clear from FIG. 23 that the larger the shift pitch and the shorter the period, the gentler is the profiles of the thermal crown and the smaller is the difference ΔS in roll diameter corresponding to centers and edges of rolled strips.

With kinds of strips capable of making the thermal crown relatively small, for example, steel strips to be rolled at relatively lower temperatures, therefore, the shift pitch should be set at a small value so as to enlarge the thermal crown in the area corresponding to the width of strips, thereby mitigating the crown of rolled strips.

As the number of rolled strips increases, the profile of the thermal crown varies usually as shown in FIG. 24. The thermal crown or difference in roll diameter at centers and edges of the strips depends upon the number of rolled strips or coils. This relation is shown in FIG. 25 wherein the rolling is effected with the constant shift pitch 40 mm/2 coil according to the procedure in connection with FIG. 22.

As can be seen from FIG. 25, the difference ΔS in roll diameter at centers and edges varies greatly in first and latter halves of rolling. In rolling with work rolls being cyclically shifted, it is effective for mitigating the crown of rolled strips to control the difference ΔS in thermal crown in the first and latter halves of rolling cycle as explained hereinafter.

Namely, the shift pitch is made smaller to enlarge the difference ΔS in the first half of the cycle generally exhibiting small differences ΔS, and the shift pitch is made larger to suppress the difference ΔS to a small value in the latter half of the cycle, thereby stabilizing the difference ΔS throughout the rolling cycle.

FIG. 26 illustrates the difference ΔS dependent upon the variable shift pitch shown in a solid line and the constant shift pitch in a broken line. The difference ΔS is stabilized as shown in the solid line in FIG. 26, the crown of rolled strips can be mitigated and irregularities in crown of the rolled strips can be reduced throughout the cycle only by providing work rolls with initial curves.

In order to obtain strips of (JIS) SPCC having thicknesses of 2.3 mm and widths of 935 mm by the use of a finishing mill having six roll stands, work roll shifting rolling was effected with work rolls of F3, F4 and F5 stands being cyclically shifted, while shift pitches were varied in first and latter halves of rolling cycle. The results are shown in FIG. 27. FIG. 28 illustrates a variation of the difference ΔS. Following table 1 shows comparison of rolled strips produced with a constant shift pitch with those produced in the above manner according to the invention on mean values $\bar{x}$ of crowns of the rolled strips and irregularities δ of the crowns.

TABLE 1

| | Crown $\bar{x}$ of rolled strips | Irregularity & of Crown |
|---|---|---|
| Prior art | 48μ | 17.8 |
| Invention | 35μ | 8.2 |

According to this embodiment, as the difference ΔS increases rapidly in the initial half of the rolling cycle, the crown of rolled strip can be effectively reduced. Particularly, as the crown of rolls becomes larger in an earlier period in the initial half of rolling so as to reduce the crown of rolled strips, and becomes constant in the latter half of rolling so as not to produce defective rolled strips and to reduce the crown of the rolled strips.

Moreover, as the thermal crown is stabilized in the earlier period of the rolling cycle, it is possible to enlarge convex curves of initial crown of work rolls without any risk of disturbance in configuration of rolled strips and further possible to reduce the crown of the rolled strips. In the prior art, such large curves of initial crowns would cause waves in rolled strips in latter rolling of the cycle.

As to the difference in thermal crown and hence in ΔS due to periods of rolling allowed by individual pairs of work rolls in the prior art, a roll initial curve should be changed every time when the period of rolling or kind of steel is changed. In contrast herewith, according to the invention the difference ΔS can be varied by changing the shift pitch. In this manner, this technique can be applied for compensating for the difference in ΔS. Accordingly, this embodiment has advantages of enlarging the use range of rolls and improving the grinding efficiency by unifying the initial curves for several kinds of steel.

Although the above embodiment has been explained in connection with the taper end work rolls, it may be applied to normal work rolls.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A hot rolling method using a hot finishing mill including a pair of work rolls shiftable relative to each other in their axial directions and each having a tapered end at one end only of its barrel and arranged one above the other with the taper ground ends being on opposite sides to locate both edges of a plate-like material to be rolled in respective zones of said taper ground ends, said method comprising rolling a number of plate-like material sin succession in a manner that every time at least one of said plate-like materials is rolled, shifting said pair of rolls relative to each other and rolling at least one of said plate-like materials in the shifted positions of said rolls so that a distance $E_L$ from an edge of said materials to a starting point of the tapered end adjacent the barrel of one of the work rolls is increased stepwise until the distance $E_L$ arrives at its maximum allowable value, and decreasing thereafter the distance $E_L$ stepwise until it arrives at its minimum allowable value associated with the other work roll, determining the maximum value of the shifting distance such that the shape of the materials on an exit side of the rolls does not exceed a limit value of the shape of the materials, determining the minimum value of the shifting distance such that it is not less than a value enabling their crown-controlling performance to be maintained, repeating the rolling and shifting in this manner and stepwise varying the distance $E_L$ between the maximum and minimum allowable distances associated with the pair of work rolls every rolling of at least one material, thereby preventing edge built-ups of the material and simultaneously controlling edge drops of the material within a constant range.

2. A hot rolling method as set form in claim 1, further comprising applying a bending force to said work rolls, said bending force applied to the work rolls being small when rolling with a large distance $E_L$ and large when rolling with a small distance $E_L$.

3. A hot rolling method as set forth in claim 1, further comprising decreasing said maximum allowable values of the distance $E_L$ as thermal expansion of the work rolls increases.

4. A hot rolling method as set forth in claim 1, further comprising increasing in a stepwise manner the shifting distance of said work rolls to be shifted in one shifting as the number of materials rolled by the work rolls increases.

* * * * *